US006941866B2

(12) United States Patent
Schneider et al.

(10) Patent No.: US 6,941,866 B2
(45) Date of Patent: Sep. 13, 2005

(54) MECHANISM FOR POSITIONING A CYLINDER DRESSING

(75) Inventors: Georg Schneider, Würzburg (DE); Karl Robert Schäfer, Rimpar (DE); Wolfgang Peter Zink, Theres (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/495,741

(22) PCT Filed: Nov. 22, 2002

(86) PCT No.: PCT/DE02/04289

§ 371 (c)(1),
(2), (4) Date: May 26, 2004

(87) PCT Pub. No.: WO03/047861

PCT Pub. Date: Jun. 12, 2003

(65) Prior Publication Data

US 2005/0000381 A1 Jan. 6, 2005

(30) Foreign Application Priority Data

Nov. 28, 2001 (DE) ..... 101 58 158

(51) Int. Cl.[7] ..... B41L 3/02; B41L 39/00
(52) U.S. Cl. ..... 101/486; 101/483; 101/484
(58) Field of Search ..... 101/486, 483, 101/484

(56) References Cited

U.S. PATENT DOCUMENTS 2,588,385 A * 3/1952 Hillmer et al. ..... 355/87
2,915,010 A * 12/1959 Crafts ..... 101/378
3,299,805 A * 1/1967 Mulreed et al. ..... 101/65
5,331,892 A 7/1994 Seib et al.
5,526,747 A 6/1996 Marmin et al.
5,537,922 A 7/1996 Becker
5,758,579 A 6/1998 Marmin et al.
5,806,431 A * 9/1998 Muth ..... 101/486
6,135,027 A 10/2000 Rudzewitz et al.
6,467,412 B1 10/2002 Tobe et al.

FOREIGN PATENT DOCUMENTS

| | | | |
|---|---|---|---|
| DE | 44 17 054 | A1 | 11/1995 |
| DE | 196 20 997 | A1 | 11/1997 |
| DE | 196 20 997 | C2 | 3/1998 |
| DE | 198 03 725 | A1 | 8/1999 |
| EP | 0 570 702 | A1 | 11/1993 |
| EP | 0 678 382 | A1 | 10/1995 |
| EP | 0 678 383 | A1 | 10/1995 |
| EP | 1 084 838 | A1 | 3/2001 |

* cited by examiner

*Primary Examiner*—Andrew H. Hirshfeld
*Assistant Examiner*—Marvin P. Crenshaw
(74) *Attorney, Agent, or Firm*—Jones Tullar & Cooper, PC

(57) ABSTRACT

A mechanism is used for mounting a dressing on a cylinder of a printing press. The mechanism is fitted with at least one stop which is effective in an axial direction of the cylinder. The stop allows the cylinder dressing to be arranged on the cylinder with pressure in the axial direction. The stop is situated outside of the cylinder.

10 Claims, 3 Drawing Sheets

MECHANISM FOR POSITIONING A CYLINDER DRESSING

FIELD OF THE INVENTION

The present invention is directed to a device for positioning a dressing on a cylinder of a printing press. At least one detent, or stop, which acts in an axial direction of the cylinder, is situated outside the cylinder.

BACKGROUND OF THE INVENTION

EP 0678 383 A1 shows a device for changing printing formes. Horizontally movable holding elements temporarily fix the printing plate to be positioned in place. Each holding element has a lateral detent, and can be moved in the axial direction by operation of an actuating unit.

A device has been disclosed in EP 1 084 838 A1, which is used in one position as a holding device for a printing plate to be fed in, and in a second positions as a protection device. It is pivotable around a pivot axis on the plate feeding surface and has a lateral guide plate.

Various embodiments of a device for use in arranging lateral detents for the axial positioning of a printing plate are disclosed in DE 196 20 997 C2. In one embodiment of the device, the detents themselves can be brought into various positions. In another embodiment, several detents assigned to a plate selectively act together with plates of different widths by a step-like offsetting of the detents.

SUMMARY OF THE INVENTION

The object of the present invention is directed to providing a device for use in positioning a different number of dressings of various widths.

In accordance with the present invention, this object is attained by providing at least one detent or stop, which acts in an axial direction of the cylinder, outside of the cylinder. In a first operating situation, a first number of detents are arranged on a dressing feeding surface. In a second operating situation, a second number of detents, which second number is different from the first number, are provided.

The advantages which can be gained by the present invention lie, in particular, in that the introduction of a dressing, for example a printing forme, is possible, which dressing introduction is exact in the axial direction of a cylinder, without it being necessary to provide an adjustable detent in or on the cylinder. The device is accessible in a simple way, is adjustable, can be driven by a drive and can be exchanged when required, and in accordance with a further embodiment, assures a dependable and positionally correct removal of the printing plate. In this way, the prerequisites for an automatic or for a semi-automatic dressing change, in particular, are considerably improved.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
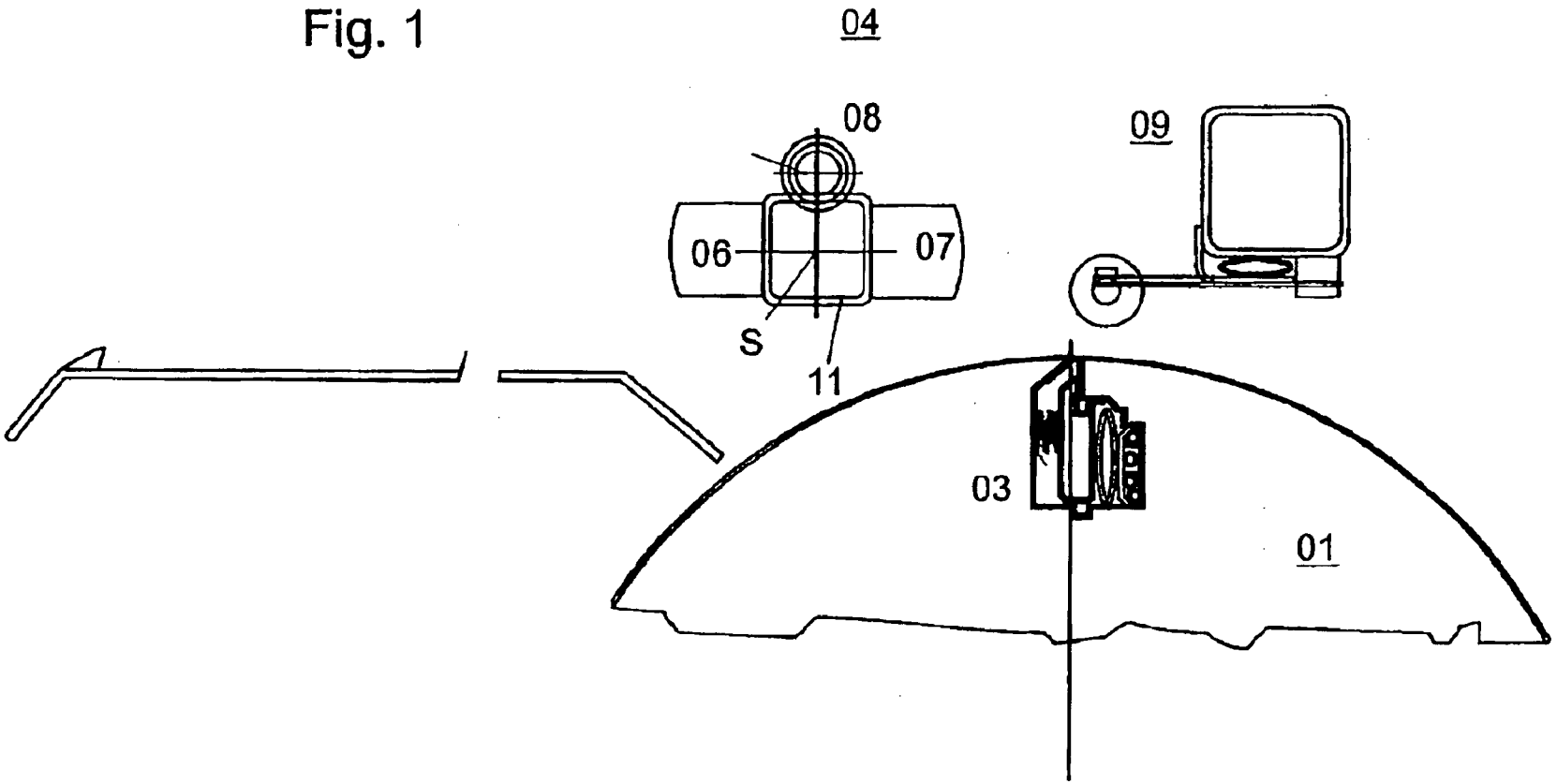
FIG. 1, a side elevation view of the device in accordance with the present invention in a first operating situation, in FIG. 2, a side elevation view of the device in a second operating situation, in FIG. 3, a top plan view of the device in the operating situation depicted in FIG. 1, and in FIG. 4, a top plan view of the device in the operating situation depicted in FIG. 2.
Figure 2:
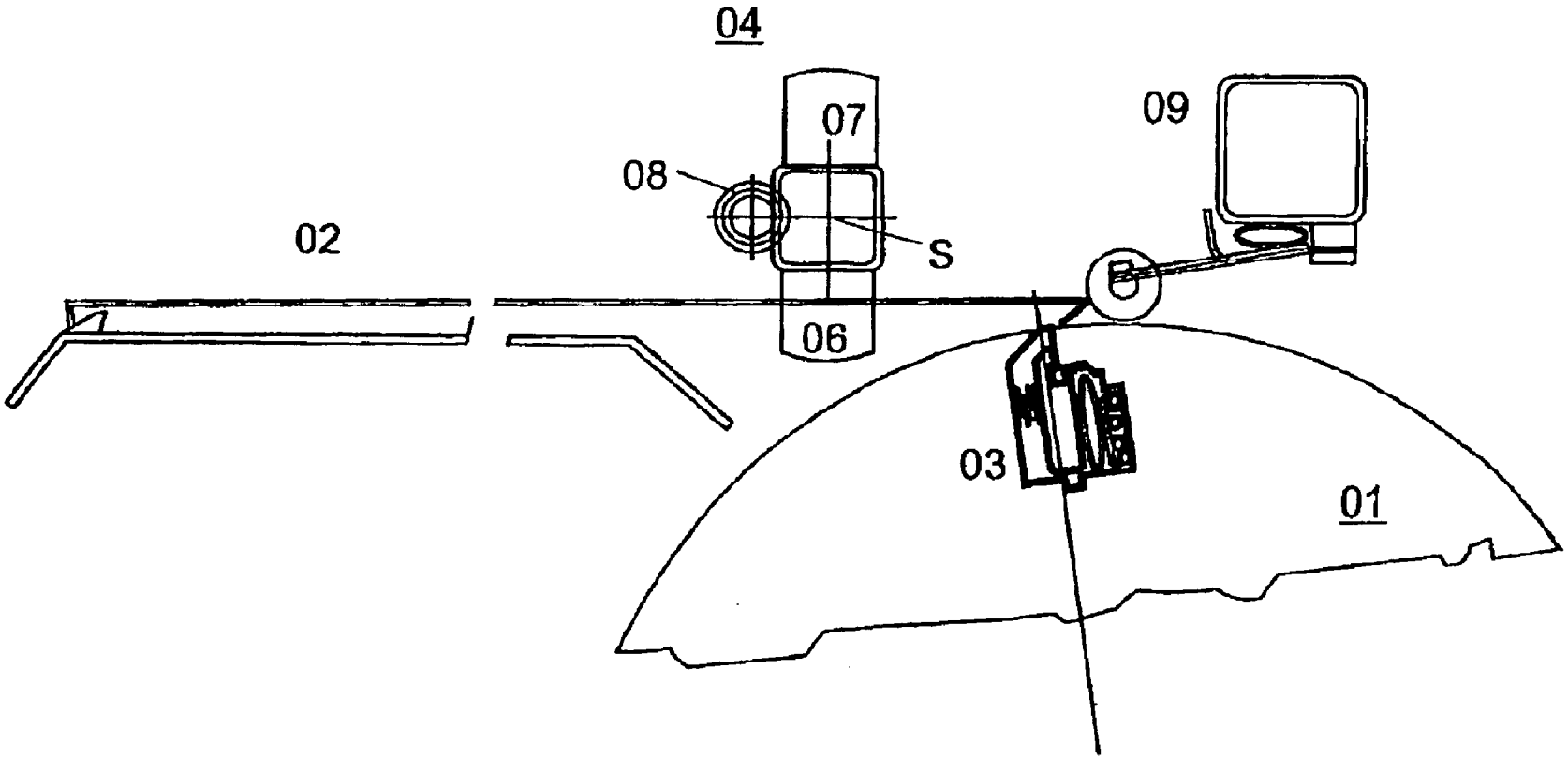

A cylinder 01, for example a forme cylinder or a transfer cylinder, as seen in FIGS. 1 and 2, is to be provided with a dressing 02 such as, for example, a printing forme or a rubber blanket, particularly one embodied as a metallic printing blanket, as seen in FIG. 2. For this purpose, the dressing 02 is fed to the cylinder 01, via for example, a table, so that a beveled first end of the dressing 02 can be introduced into a groove in cylinder 01. In a particular embodiment, a dressing end clamping device 03 can be arranged in the groove. However, the dressing ends can also be held in cylinder 01 by the cooperative shaping of the dressing end and the cylinder groove and without the use of a clamping device 03. To insure that that the dressing 02, and in particular the printing forme, is fed in, in the axial direction of the cylinder 01, in the correct position and, if required, is fixed in place, a device 04 for guiding the dressing, or for the axial alignment of the dressing, is provided outside the cylinder.

Figure 3:
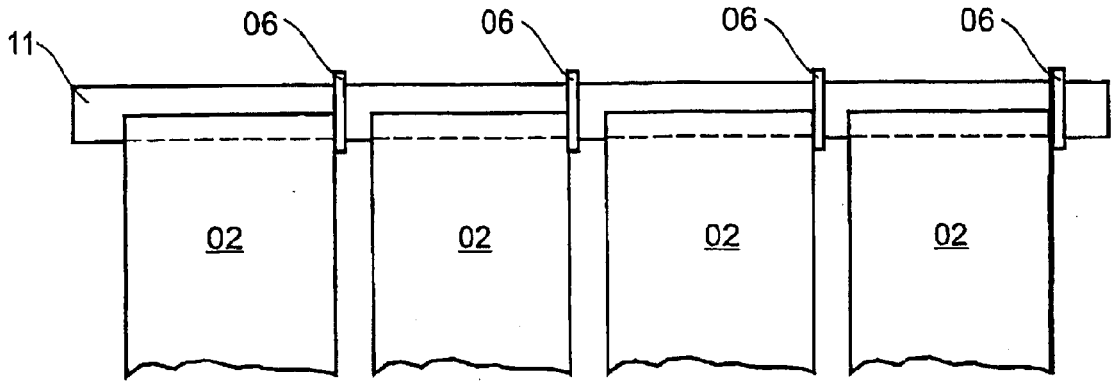

The dressing axial alignment or guiding device 04 has a pivot axis S, which pivot axis S is substantially parallel with the longitudinal direction of the cylinder. At least one detent 06, 07 can be pivoted about this pivot axis S. For example, this detent 06, or 07 is pivoted away, or out of a use position, for an operating situation in which no dressing change is to take place, as depicted in FIG. 1, and pivoted in, or into a use position, if the dressing is to be fed in, as depicted in FIG. 2. Four such detents 06, one for each of four printing formes 02, for example, are arranged on a shaft 11 or a pivotable cross bar 11, which shaft or cross bar 11 extends over the length of the cylinder 01, which cylinder length corresponds, for example, substantially to the width of four printed pages, for example four newspaper pages, as seen in FIG. 3. The printing formes 02 are pushed, for example by a spring force, against the respective lateral detent 06, 07.

Figure 4:
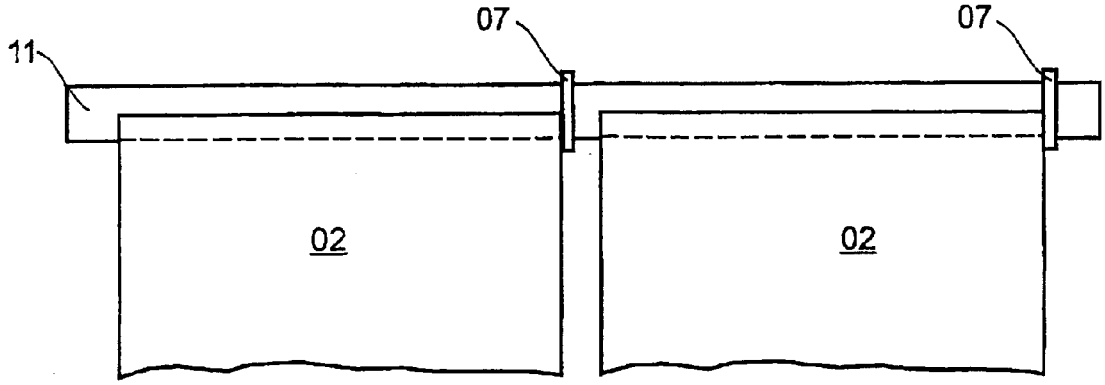

Two detents 07 are provided over the length of the cylinder 01, or the shaft 11, as seen in FIG. 4. Detents 07 can be pivoted into their use position for the case of double-wide printing formes 02.

The device 04 for the axial alignment of dressings is embodied in such a way, that in a first operating situation, a first defined number of n detents 06 can be brought onto a use position, or are arranged on a feeding surface of the dressing 02, and in a second operating situation, a second defined number m of detents 07, which is different from the number first defined n can be brought into the use position. FIGS. 3 and 4 show these two operating situations by the example of a printing press, or of a cylinder 01, whose length is configured for the printing of four pages arranged next to each other, in particular for four newspaper pages. In FIG. 3, four printing forms 02, each having, for example, a width of a printed page, and in particular for a newspaper page, can be fed to the cylinder and are laterally guided by four detents 06. In FIG. 4 only two detents 07 have been brought onto an operative position with respect to the feeding surface of two double-width printing formes 02, each having, for example, a width of two printed pages, in particular two newspaper pages, for example two panorama printing formes 02. If the cylinder 01 is embodied with a length adapted for the printing of six side-by-side arranged printed pages, in particular for six newspaper pages, in an embodiment which is not specifically depicted, in the one operating situation six detents 06 can be brought onto the feeding surface, and in the other operating situation three detents 07 can be positioned on the feeding surface. For k printed pages which can be arranged side-by-side on the cylinder 01, n=2*m, and n=k applies.

Depending on the operating situation, in the above mentioned embodiments one detent 06, or 07 is assigned to each one of the dressings 02, respectively for one-sided guidance of each dressing 02. The detents 06, 07 are advantageously each arranged on the same side of the respective dressing 02 to be fed in, in particular on a left side of a script located on the dressing.

In another preferred embodiment, which is not specifically depicted, a common detent 06, 07, which has two detent faces facing away from each other and respectively facing the dressings 02 to be fed in, is arranged between each of two dressings to be fed in. Thus, for a cylinder 01 whose width is configured for four side-by-side arranged printed pages, the device has three such detents 06, 07 in the one operating situation, and in the other operating situation only one detent 06, 07. For six side-by-side arranged printed pages there are five, or two detents 06, 07. Here, n=k−1 and n=2*(m+1)−1 generally applies.

In a further development of the present invention, the device can also be embodied in such a way that, although in the second operating situation fewer than n detents 06, 07 are used, more than the above mentioned number m can be introduced onto the feeding surface. For example, this can be the case if only a portion of the length of the cylinder 01 should be covered for printing with dressings 02 of a width of two printed pages. Thus, in a variation of FIGS. 3 and 4 for example, in the first operating situation four detents 06, corresponding to the four dressings 02, could be supplied. In the second operating situation, two dressings 02 of single width and one dressing 02 of double-width would be aligned, if the device in FIG. 4, viewed from the left side, additionally would utilize the first or third detent 06 from FIG. 3. This should be correspondingly applied to the embodiment of even wider cylinders 01, as well as to the non-represented, previously mentioned embodiment with common detents 06, 07.

The device for positioning a cylinder dressing and for the pivoting of the device can be integrated into a full-or a semi-automated plate change. The axial position of the detents 06. 07, which may be, for example, arranged as thin plates or "wings" on a cross bar 11 to be pivoted, for example a square tube, can be individually adjustable, if required. The entire device 04 can be axially adjustable, if desired.

In a further embodiment of the present invention, the device 04 has one or several rollers 08, which rollers 08 are different from the detents 06, 07, and which rollers 08 are situated on a side of shaft or bar 11, which rollers 08 hold down the printing forme 02 to be installed or during removal of the printing forme 02 from the cylinder 01, after the appropriate pivoting of the device 04, so that it comes to rest in the correct position on the table, for example against a detent. A further aid device 09 for use in pulling on the dressing 02, or for removing it, can have one or several rollers, which can be placed against the dressing.

The selective placing of detents 06, 07 onto the feeding surface can also take place in another way. For example, a first set of detents 06 and a second set of detents 07 can be brought onto the feeding surface independently of each other by respective linear or pivoting movements. In a different variant, single detents 06, 07, or groups of detents 06, 07 can be moved onto or out of the feeding surface, for example by their own drive mechanisms. For example, all of the detents 06 can be brought onto the surface in the first operating situation, while some ones of these detents 06 can be moved out of the surface in the second operating situation. Then, the number of detents 07 becoming effective in the second operating situation correspond to a partial number of detents 06. This embodiment can then be appropriately controlled, for example by the use of a control device, which is not specifically represented, so that, in the one selectable operating situation, all detents 06, for example, are effective, and in another operating situation a partial number of the detents 06 are used as detents 07.

In connection with all of the embodiments of the present invention, it is applicable that the device advantageously has an operating situation in which none of the detents 06, 07 are arranged on the feeding surface.

While preferred embodiments of a mechanism for positioning a cylinder dressing, in accordance with the present invention, have been set forth fully and completely hereinabove, it will be apparent to one of skill in the art that various changes in, for example the type of material to be printed, the specific type of printing press, and the like could be made without departing from the true spirit and scope of the present invention which is accordingly to be limited only by the appended claims.

What is claimed is:

1. A device for axially aligning at least one dressing to be fed to a printing press comprising:

a cylinder adapted to receive at least one dressing:

a support surface positioned adjacent said cylinder and adapted to support said at least one dressing;

a first number n of detents arranged adjacent the cylinder and adapted to act in an axial direction of the cylinder in a first operating situation; and a second number m of detents arranged adjacent the cylinder and adapted to act in said axial direction of the cylinder in a second operating situation, wherein said first number n is different from said second number m.

2. The device of claim 1 wherein n=2*m.

3. The device of claim 1 wherein n=2*(m +1)−1.

4. The device of claim 2 wherein said cylinder has a length for printing a number k of side-by-side arranged newspaper pages and wherein n=k.

5. The device of claim 3 wherein said cylinder has a length for printing a number k of side-by-side arranged newspaper pages and wherein n=k−1.

6. The device of claim 1 wherein said cylinder has a length for printing four side-by-side newspaper pages.

7. The device of claim 1 wherein said cylinder has a length for printing six side-by-side newspaper pages.

8. The device of claim 1 wherein each said detent is supported for pivotal movement about a pivot axis which is parallel to a longitudinal axis of said cylinder.

9. The device of claim 1 wherein each said detent is arranged on a pivotable cross bar.

10. The device of claim 1 further including at least one roller adapted to engage the dressing and to guide the dressing.

* * * * *